US008052494B1

(12) United States Patent
Whitten

(10) Patent No.: US 8,052,494 B1
(45) Date of Patent: Nov. 8, 2011

(54) PERSONAL WATERCRAFT PADDLE MOUNTING SYSTEM

(76) Inventor: Edward A. Whitten, Orange City, FL (US)

( * ) Notice: Subject to any disclaimer, the term of this patent is extended or adjusted under 35 U.S.C. 154(b) by 76 days.

(21) Appl. No.: 12/653,011

(22) Filed: Dec. 8, 2009

(51) Int. Cl.
*B63H 16/00* (2006.01)

(52) U.S. Cl. ..... 440/104; 114/347; 114/364

(58) Field of Classification Search ..... 114/347, 114/364; 440/104
See application file for complete search history.

(56) References Cited

U.S. PATENT DOCUMENTS 468,960 A 2/1892 Vondersaar
2,708,758 A * 5/1955 Gross ..... 114/364
5,127,859 A 7/1992 Rantilla
6,027,387 A * 2/2000 Allin ..... 440/104
6,109,988 A 8/2000 Dunn, Jr.
6,645,025 B2 11/2003 Oathout
6,755,145 B2 6/2004 Bolebruch
6,796,863 B1 9/2004 Oathout

* cited by examiner

*Primary Examiner* — Stephen Avila

(57) ABSTRACT

A personal watercraft paddle mounting system includes a personal watercraft that has a hull and a top wall attached to the hull. The hull includes an aft portion and a bow portion. The top wall has an opening therein to receive a person. The opening is positioned between the aft and bow portions. A sleeve extends into the top wall adjacent to a forward edge of the opening between the opening and the bow portion. A mount is removably positioned in the sleeve and extends upwardly therefrom. A coupler is attached to the mount and is engageable with a double ended paddle to allow the paddle to rest on the mount while ends of the paddle are engageable with water to propel the personal watercraft.

5 Claims, 5 Drawing Sheets

PERSONAL WATERCRAFT PADDLE MOUNTING SYSTEM

BACKGROUND OF THE DISCLOSURE

Field of the Disclosure

The disclosure relates to paddle mounting systems and more particularly pertains to a new paddle mounting system for attaching a paddle to a small boat in such a manner that the paddle may be effectively and more efficiently utilized.

SUMMARY OF THE DISCLOSURE

An embodiment of the disclosure meets the needs presented above by generally comprising a personal watercraft that has a hull and a top wall attached to the hull. The hull includes an aft portion and a bow portion. The top wall has an opening therein to receive a person. The opening is positioned between the aft and bow portions. A sleeve extends into the top wall adjacent to a forward edge of the opening between the opening and the bow portion. A mount is removably positioned in the sleeve and extends upwardly therefrom. A coupler is attached to the mount and is engageable with a double ended paddle to allow the paddle to rest on the mount while ends of the paddle are engageable with water to propel the personal watercraft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
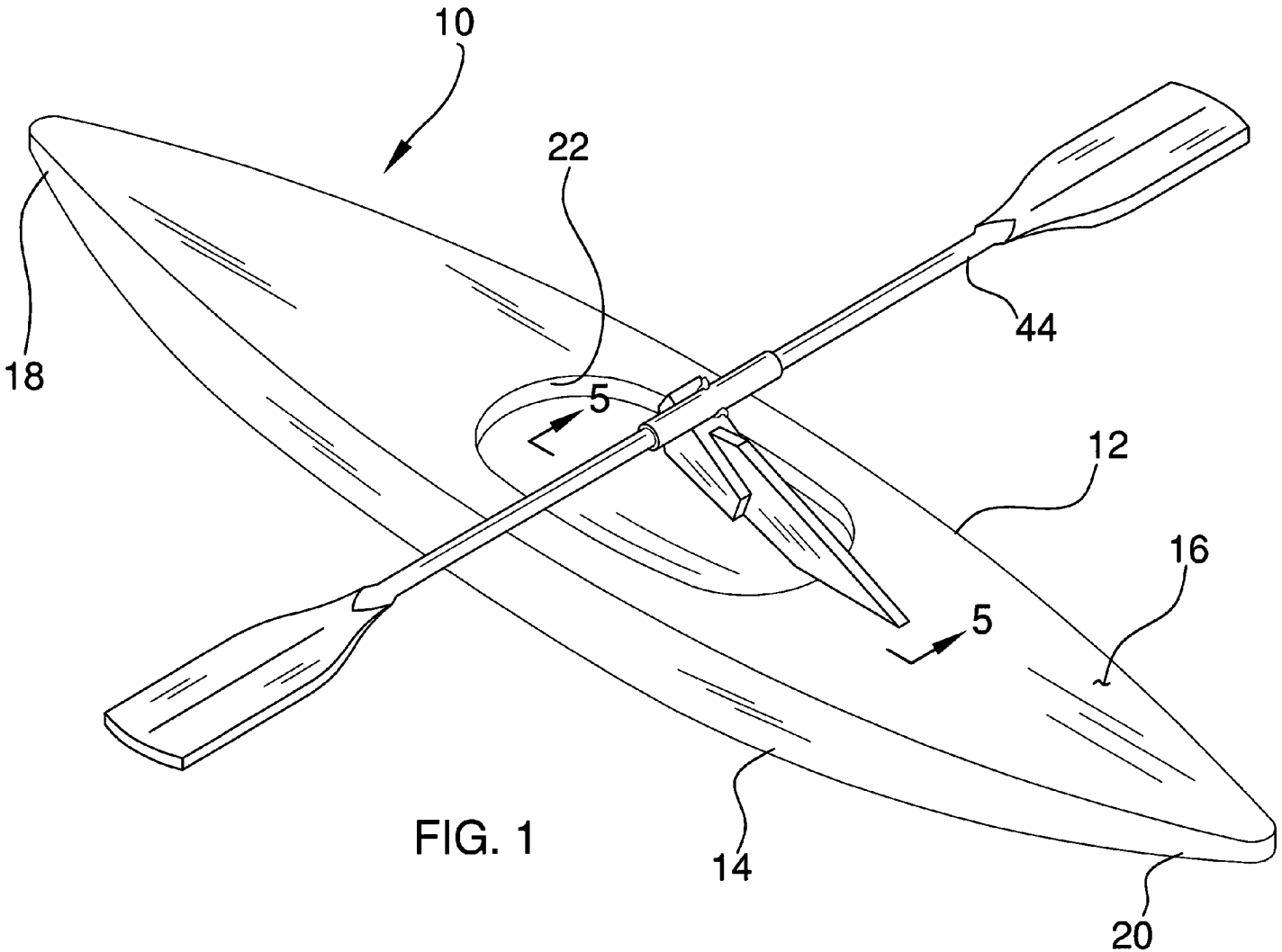
FIG. 1 is a top perspective view of a personal watercraft paddle mounting system according to an embodiment of the disclosure.
Figure 2:
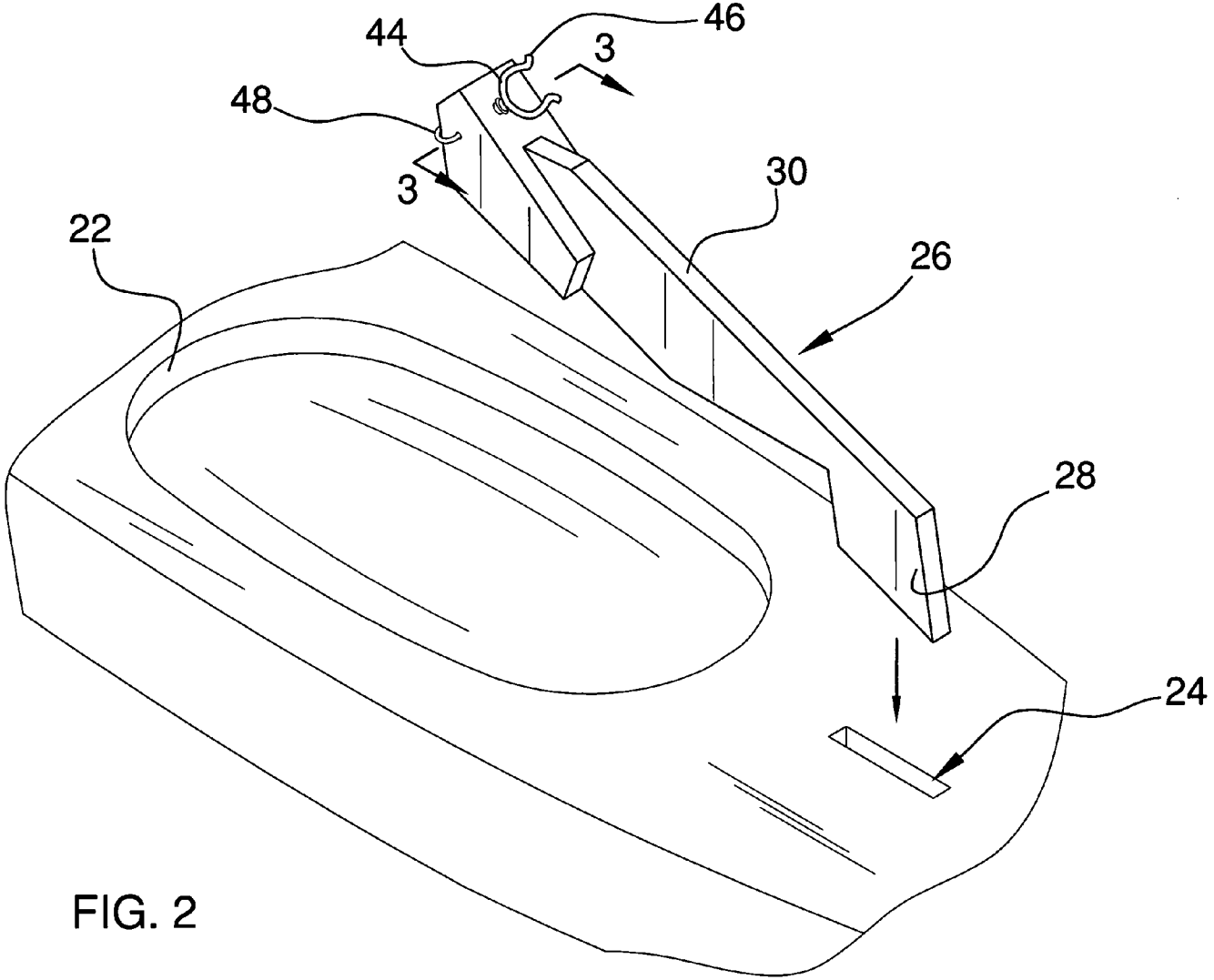
FIG. 2 is a broken and enlarged top perspective view of an embodiment of the disclosure.
Figure 3:
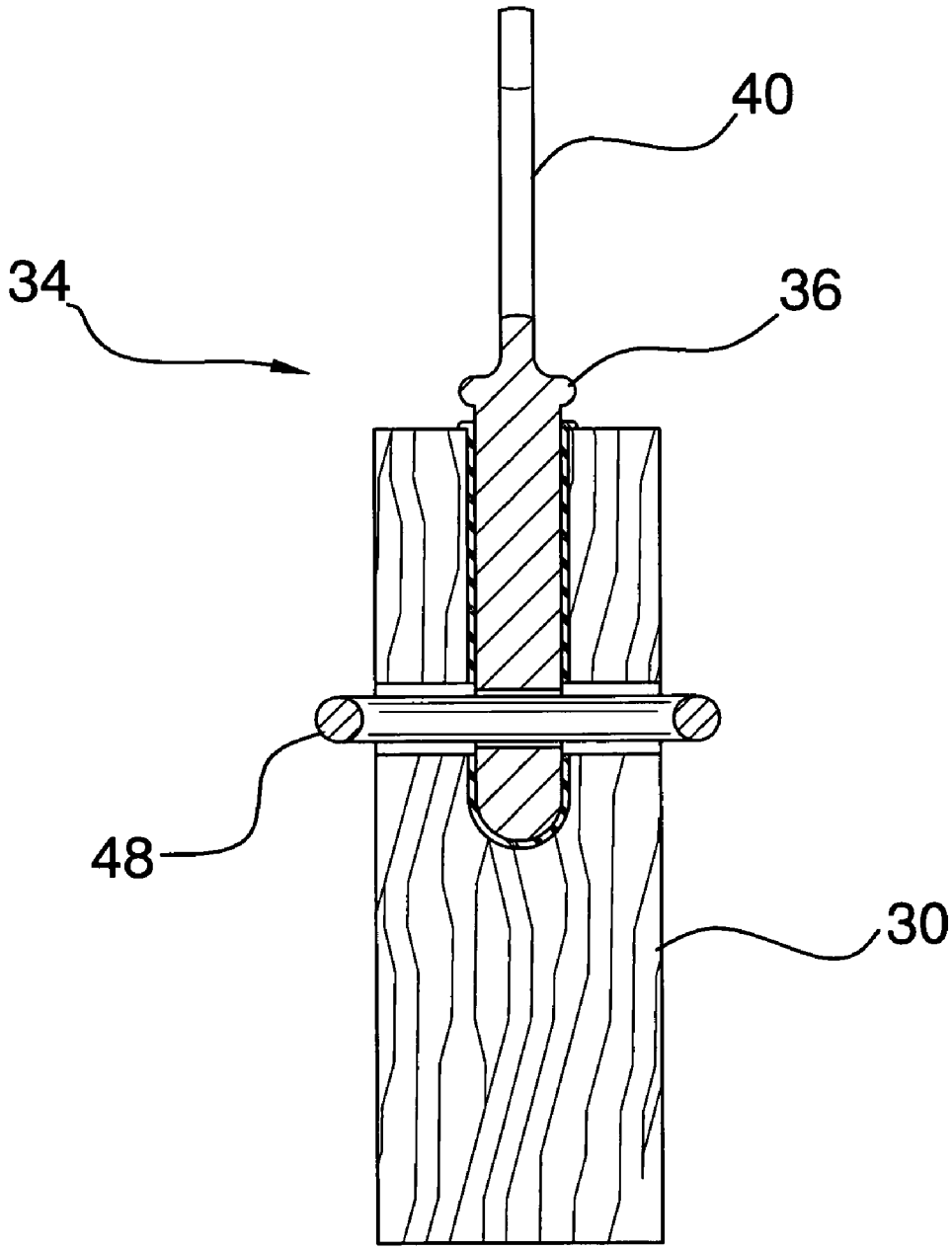
FIG. 3 is a cross-sectional view taken along line 3-3 of FIG. 2 of an embodiment of the disclosure.
Figure 4:
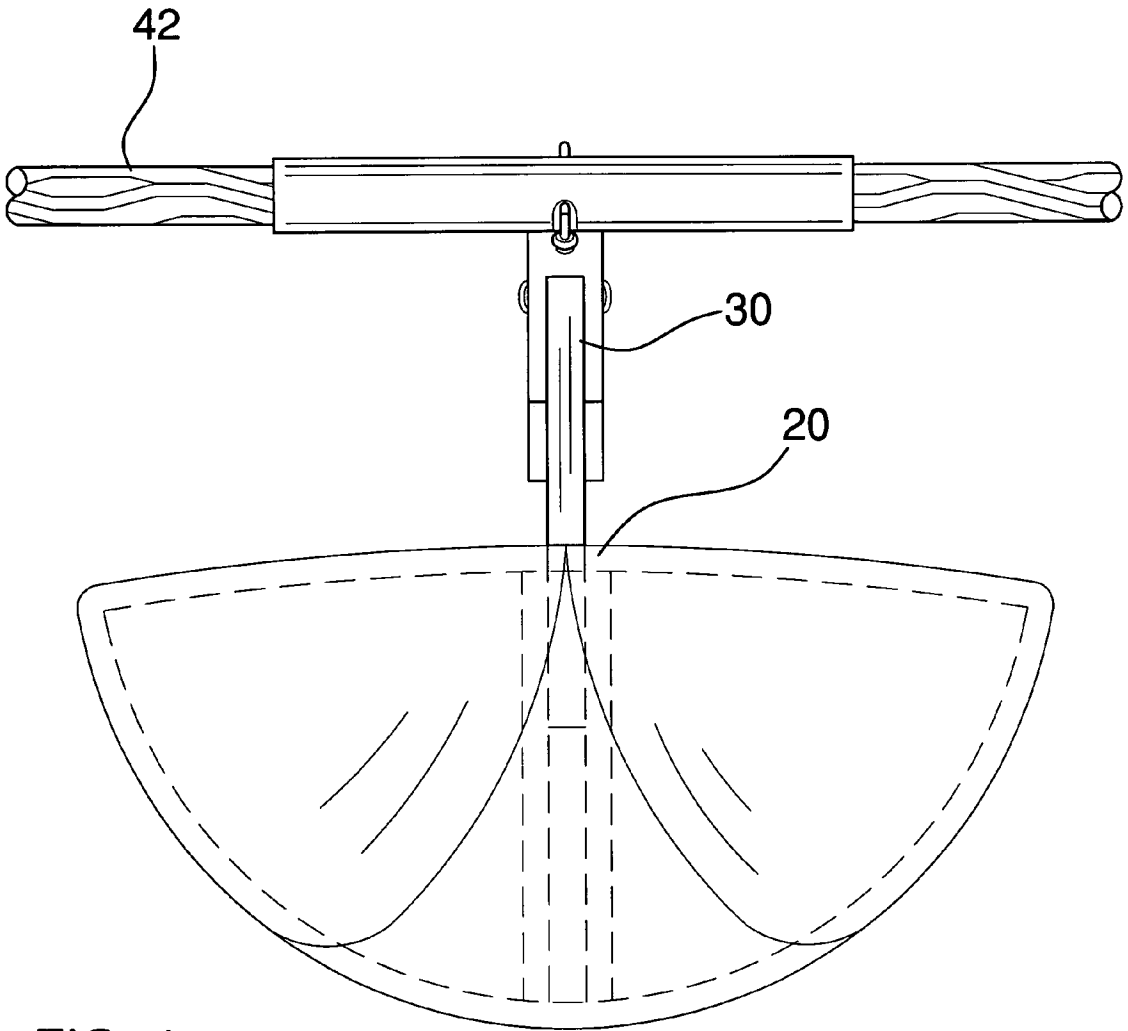
FIG. 4 is a front view of an embodiment of the disclosure.
Figure 5:
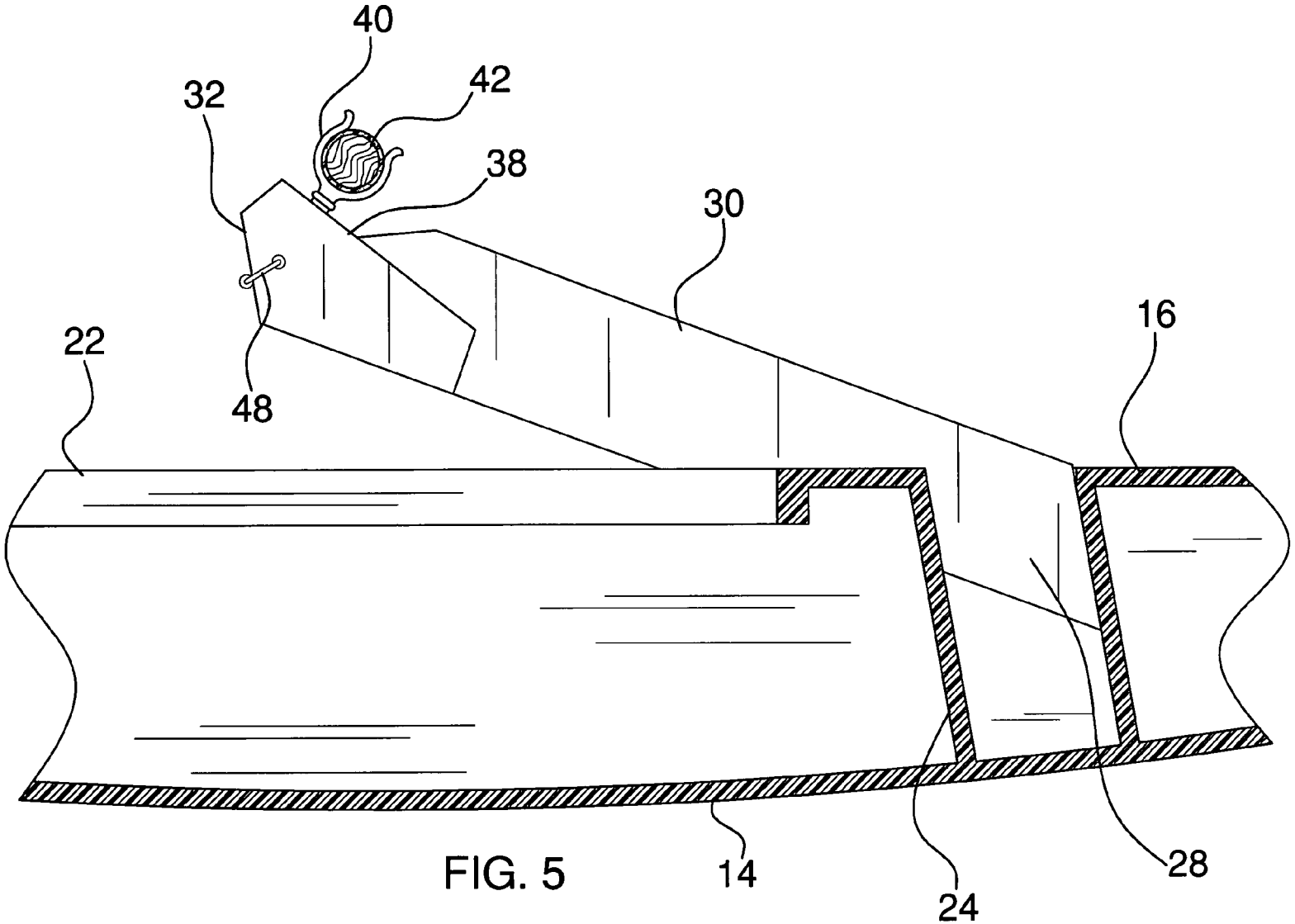
FIG. 5 is a cross-sectional view of an embodiment of the disclosure taken along line 5-5 of FIG. 1.

With reference now to the drawings, and in particular to FIGS. 1 through 5 thereof, a new paddle mounting system embodying the principles and concepts of an embodiment of the disclosure and generally designated by the reference numeral 10 will be described.

As best illustrated in FIGS. 1 through 5, the personal watercraft paddle mounting system 10 generally comprises a personal watercraft 12 that has a hull 14 and a top wall 16 that is attached to the hull 14. The hull 14 includes an aft portion 18 and a bow portion 20. The top wall 16 has an opening 22 therein to receive a person and is positioned between the aft 18 and bow 20 portions. The watercraft 12 is may comprise a conventional small boat for typically holding one or two persons and which is conventionally known as a car-topper boat or a car-topper board boat.

A sleeve 24 extends into the top wall 16 adjacent to a forward edge of the opening 22 between the opening 22 and the bow portion 20. The sleeve 24 is spaced from lateral walls of the watercraft 12 to provide area for a person's feet. A mount 26 is removably positioned in the sleeve 24 and extends upwardly therefrom. The mount 26 includes a leg portion 28 and an arm portion 30 that are angled with respect to each other. The leg portion 28 is extended into the sleeve 24. The arm portion 30 extends upwardly and rearwardly from the bow portion 20 to position a free end 32 of the arm portion 30 over the opening 22. The angle formed by the arm 30 and leg 28 portions is between 100 degrees and 150 degrees. The leg portion 28 and the sleeve 24 each have a horizontal orientated rectangular cross-section to prevent rotation of the leg portion 28 with respect to the sleeve 24.

A coupler 34 is attached to the arm portion 30 adjacent to the free end 32. The coupler 34 includes a mounting rod 36 removably extended into an upper edge 38 of the arm portion 30 and a clip 40 attached to the rod 36 and positioned over the arm portion 30. A double ended paddle 42 is positionable in and frictionally engageable with the clip 40 to allow the paddle 42 to rest on the arm while ends of the paddle 42 are engageable with water to propel the personal watercraft 12 as needed. The clip 40 is a loop 44 having a break 46 therein to snappily and frictionally receive the paddle 42. The clip 40 allows both ends of the paddle 42 to be used while the paddle 42 is attached to the clip 40. A locking pin 48 extends through the arm 30 and the coupler 34. The locking pin 48 retains the rod 36 in the arm 30 and prevents rotation of the rod 36.

In use, the mount 26 is extended into the watercraft 12 and the paddle 42 locked into the clip 40. The paddler then uses the paddle 42 in a conventional manner but is able to use the top wall 16 for leverage to exert greater force on the ends of the paddle 42. This will lead to more efficient paddling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A paddle mounting system comprising:

a personal watercraft having a hull and a top wall being attached to said hull, said hull including an aft portion and a bow portion, said top wall having an opening therein to receive a person and being positioned between said aft and bow portions;

a sleeve extending into said top wall adjacent to a forward edge of said opening between said opening and said bow portion;

a mount being removably positioned in said sleeve and extending upwardly therefrom; and a coupler being attached to said mount and being engageable with a double ended paddle to allow said paddle to rest on said mount while ends of said paddle are engageable with water to propel the personal watercraft, said mount including a leg portion and an arm portion being angled with respect to each other, said leg portion being extended into said sleeve, said arm portion extending upwardly and rearwardly from said bow portion to position a free end of said arm portion over said opening, said coupler being mounted on said arm portion adjacent to said free end.

2. The system according to claim 1, wherein said leg portion and said sleeve each have a horizontal orientated rectangular cross-section to prevent rotation of said leg portion with respect to said sleeve.

3. The system according to claim 1, wherein said coupler includes a mounting rod removably extended into an upper edge of said arm portion and a clip attached to said rod and being positioned over said arm portion, wherein the double ended paddle is positionable in and frictionally engageable with said clip.

4. The system according to claim 3, further including a locking pin extending through said arm and said coupler, said locking pin retaining said rod in said arm and preventing rotation of said rod.

5. A paddle mounting system comprising:

a personal watercraft having a hull and a top wall being attached to said hull, said hull including an aft portion and a bow portion, said top wall having an opening therein to receive a person and being positioned between said aft and bow portions;

a sleeve extending into said top wall adjacent to a forward edge of said opening between said opening and said bow portion;

a mount being removably positioned in said sleeve and extending upwardly therefrom, said mount including a leg portion and an arm portion being angled with respect to each other, said leg portion being extended into said sleeve, said arm portion extending upwardly and rearwardly from said bow portion to position a free end of said arm portion over said opening, said leg portion and said sleeve each having a horizontal orientated rectangular cross-section to prevent rotation of said leg portion with respect to said sleeve;

a coupler being attached to said arm portion adjacent to said free end, said coupler including a mounting rod removably extended into an upper edge of said arm portion and a clip attached to said rod and being positioned over said arm portion, wherein a double ended paddle is positionable in and frictionally engageable with said clip to allow said paddle to rest on said arm while ends of said paddle are engageable with water to propel the personal watercraft; and a locking pin extending through said arm and said coupler, said locking pin retaining said rod in said arm and preventing rotation of said rod.

* * * * *